US005638848A

United States Patent [19]

November

[11] Patent Number: 5,638,848

[45] Date of Patent: Jun. 17, 1997

[54] TENT

[75] Inventor: Carl J. November, West Hampton Beach, N.Y.

[73] Assignee: Acadamy Broadway Corp., Smithtown, N.Y.

[21] Appl. No.: 405,207

[22] Filed: Mar. 16, 1995

Related U.S. Application Data

[63] Continuation of Ser. No. 15,157, Nov. 9, 1993, Pat. No. Des. 358,191.

[51] Int. Cl.[6] ..... E04H 15/44

[52] U.S. Cl. ..... 135/90; 135/156; 135/157; 135/900; 135/902; 135/160; 135/121

[58] Field of Search ..... 135/90, 156, 157, 135/158, 122, 143, 121, 139, 160, 900, 902, 908; D21/114, 118, 253

[56] References Cited

U.S. PATENT DOCUMENTS

| | | | |
|---|---|---|---|
| 2,646,057 | 7/1953 | Blanchard . | |
| 2,847,017 | 8/1958 | Drago | 135/157 |
| 2,897,831 | 8/1959 | Liden | 135/160 |
| 2,963,030 | 12/1960 | Blanchard . | |
| 3,058,480 | 10/1962 | Blanchard | 135/156 X |
| 3,168,101 | 2/1965 | Porter | 135/156 |
| 3,342,192 | 9/1967 | Tombari | 135/156 X |
| 3,424,178 | 1/1969 | Yazaki . | |
| 3,454,021 | 7/1969 | Morris | 135/156 |
| 3,599,651 | 8/1971 | Perry | 135/156 X |
| 3,670,747 | 6/1972 | Pohl et al. | 135/156 X |
| 3,834,410 | 9/1974 | Leibel . | |
| 3,943,953 | 3/1976 | Cantwell et al. . | |
| 4,066,089 | 1/1978 | Rainwater . | |
| 4,285,355 | 8/1981 | Lundblade . | |
| 4,352,362 | 10/1982 | Nichols . | |
| 4,369,000 | 1/1983 | Egnew . | |
| 4,665,935 | 5/1987 | Nichols . | |
| 4,793,371 | 12/1988 | O'Ferrell et al. . | |
| 4,827,958 | 5/1989 | Cantwell et al. . | |
| 4,941,499 | 7/1990 | Pelsue et al. . | |
| 5,067,505 | 11/1991 | Cantwell et al. . | |
| 5,167,246 | 12/1992 | Mortenson | 135/160 X |
| 5,261,436 | 11/1993 | Funk . | |
| 5,335,685 | 8/1994 | Dahulich | 135/156 |

FOREIGN PATENT DOCUMENTS

| | | |
|---|---|---|
| 114019 | 4/1991 | Rep. of Korea . |
| 86/4383 | 12/1986 | South Africa . |

OTHER PUBLICATIONS

Cover and six pages from Interrismo/Izuno 1989 Family Camp Tent catalog.

Cover and 11 pages from 1990 edition of People and Mountains in Korea.

Cover and 14 pages from 1991 edition of People and Mountains in Korea.

Two pages from Ogawa 1992 Catalogue.

Cover and six pages from Touchwoods 1992/1993 Camping & Outdoor Life Catalogue.

Cover and two pages from Famous Stores 1993 Catalogue.

Cover and and two pages from Camping Magazine, Nov. 1993.

(List continued on next page.)

*Primary Examiner*—Wynn E. Wood

*Attorney, Agent, or Firm*—Rosen, Dainow & Jacobs Limited Liability Partnership

[57] ABSTRACT

An improved tent comprising a fabric enclosure having a floor, walls, and a roof, supported by an external, free-standing frame comprising upwardly extending leg poles, roof poles; and yoke connectors having three tubular members for releasably connecting each pole to at least two other poles. The poles have tubular ends which are dimensioned to fit within the tubular members of the yoke connectors. Each yoke connector also has a flange extending between tubular members, with an eye in the flange. The fabric enclosure hangs tautly from the frame through the use of one or more loops, one or more pole sleeves, and connectors releasably engageable with the eyes in the flanges attached to the yoke connectors.

26 Claims, 5 Drawing Sheets

OTHER PUBLICATIONS

One page from unidentified catalogue, believed to be Swedish in origin, undated.
Cover and six pages from Interrismo/Mizuno 1989 Family Camp Tent catalog.
Cover and 11 pages from 1990 edition of People and Mountains in Korea.
Cover and 14 pages from 1991 edition of People and Mountains in Korea.
Two pages from Ogawa 1992 Catalogue.
Cover and six pages from Touchwoods 1992/1993 Camping & Outdoor Life Catalogue.
Cover and two pages from Famous Stores 1993 Catalogue.
Cover and and two pages from Camping Magazine, Nov. 1993.
One page from unidentified catalogue, believed to be Swedish in origin, undated.
Copies of cover and seven pages from Academy Broadway 1991 Catalog of Tents.

TENT

This application is a continuation of application Ser. No. 29/015,157, filed Nov. 9, 1993, now U.S. Pat. No. Des. 0,358,191.

BACKGROUND OF THE INVENTION

The invention disclosed herein relates to tents.

SUMMARY OF THE INVENTION

It is an object of the present invention to provide an improved tent with an external, free-standing frame.

The above and other objects are achieved by a tent comprising a fabric enclosure having a plurality of walls and a roof, and an external, free-standing frame which supports the fabric enclosure. The fabric enclosure also includes a floor. In an assembled condition of the tent, the frame defines a space sufficiently large to encompass the fabric enclosure in its expanded condition. The frame comprises a plurality of upwardly extending leg poles with a lower end of each leg pole supported by a supporting surface to thereby support the frame, a plurality of roof poles, and a plurality of pole connectors for releasably connecting each leg pole at its upper end to at least two roof poles. The fabric enclosure is supported by the frame through first means for releasably hanging the fabric enclosure at at least one location thereof from at least one of the roof poles and second means for releasably hanging the fabric enclosure at at least one location thereof from at least one of the pole connectors.

In an assembled condition of the frame, the leg poles are spaced apart and the roof poles are arranged so that at least one roof pole extends laterally between two adjacent leg poles and at least two adjacent roof poles each have an end adjacent each other and adjacent an upper end of a given leg pole, the adjacent roof poles extending away from each other and from the given leg pole toward respective other leg poles.

In the preferred embodiment, the frame comprises four leg poles having tubular upper ends and a plurality of roof poles including one center ridge pole, two eave poles running parallel to the center ridge pole, and four ridge-to-eave poles. The roof poles each have two tubular ends and are substantially straight in an assembled condition of the tent. Each one of the four leg poles is detachably connectable at its upper end to one eave pole and one ridge-to-eave pole by a corner yoke connector having three tubular members into which the tubular ends of the respective poles are releasably insertable. Each one of the ridge-to-eave poles is detachably connectable to the center ridge pole by a center yoke connector having three tubular members into which the tubular ends of the respective poles are releasably insertable.

In the preferred embodiment, the fabric enclosure is supported by the external frame by four loops into which the eave poles are releasably insertable, a center sleeve into which the center ridge pole is releasably insertable, and six connectors affixed to the fabric enclosure at one end which at the opposing ends are releasably engageable with eyes in flanges affixed to the corner and center yoke connectors, so that the fabric enclosure hangs tautly from the frame.

BRIEF DESCRIPTION OF THE DRAWINGS

In the following accompanying drawings, like references refer to like or corresponding parts.

DESCRIPTION OF THE PREFERRED EMBODIMENT

Figure 6:
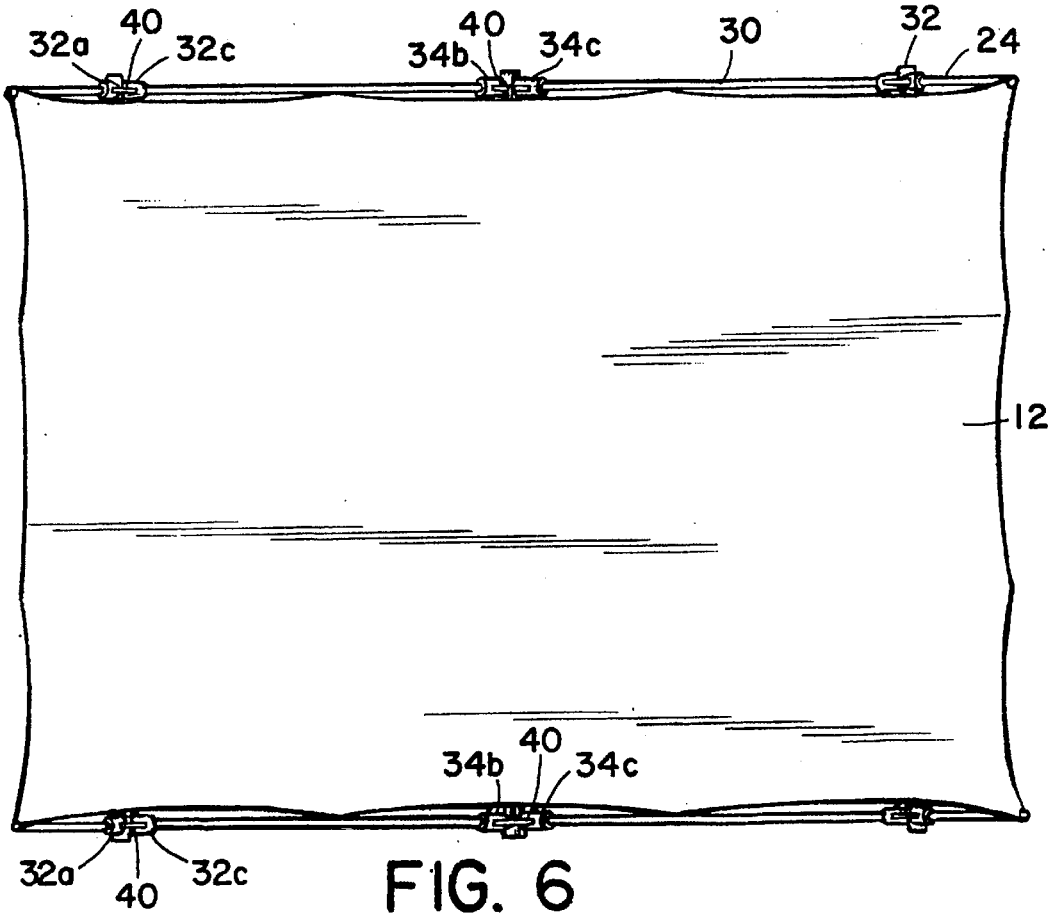
FIG. 6 is a bottom view thereof.
Figure 7:
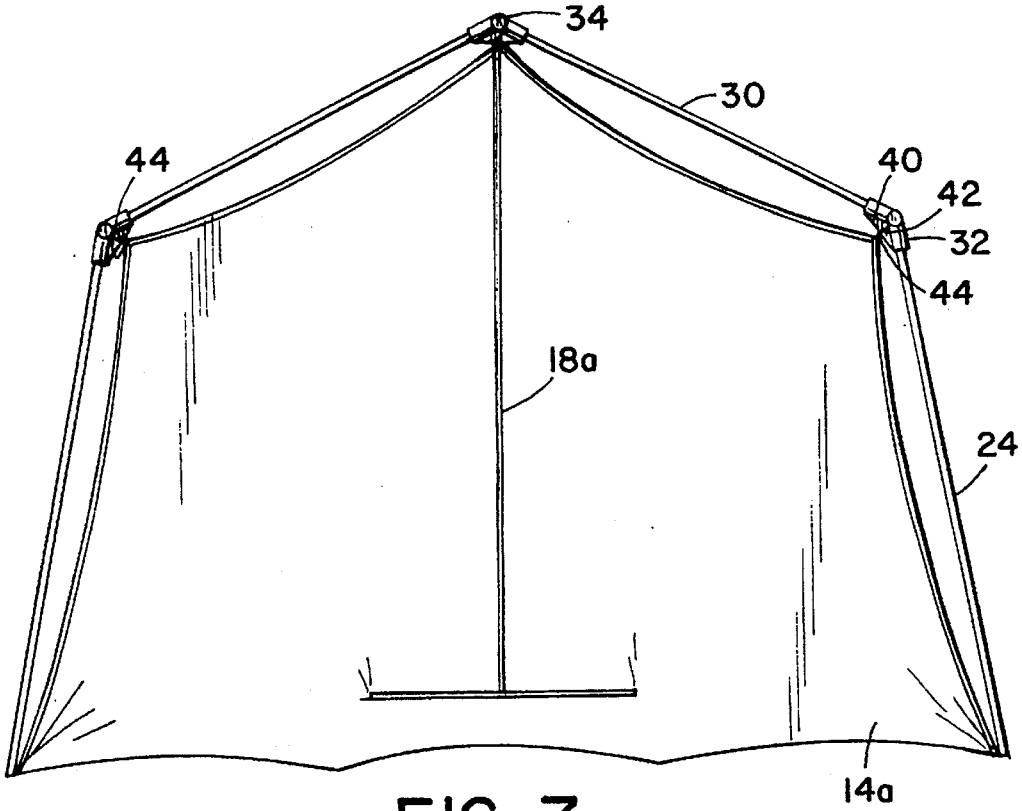
FIG. 7 is a front view thereof with the front door closed.
Figure 8:
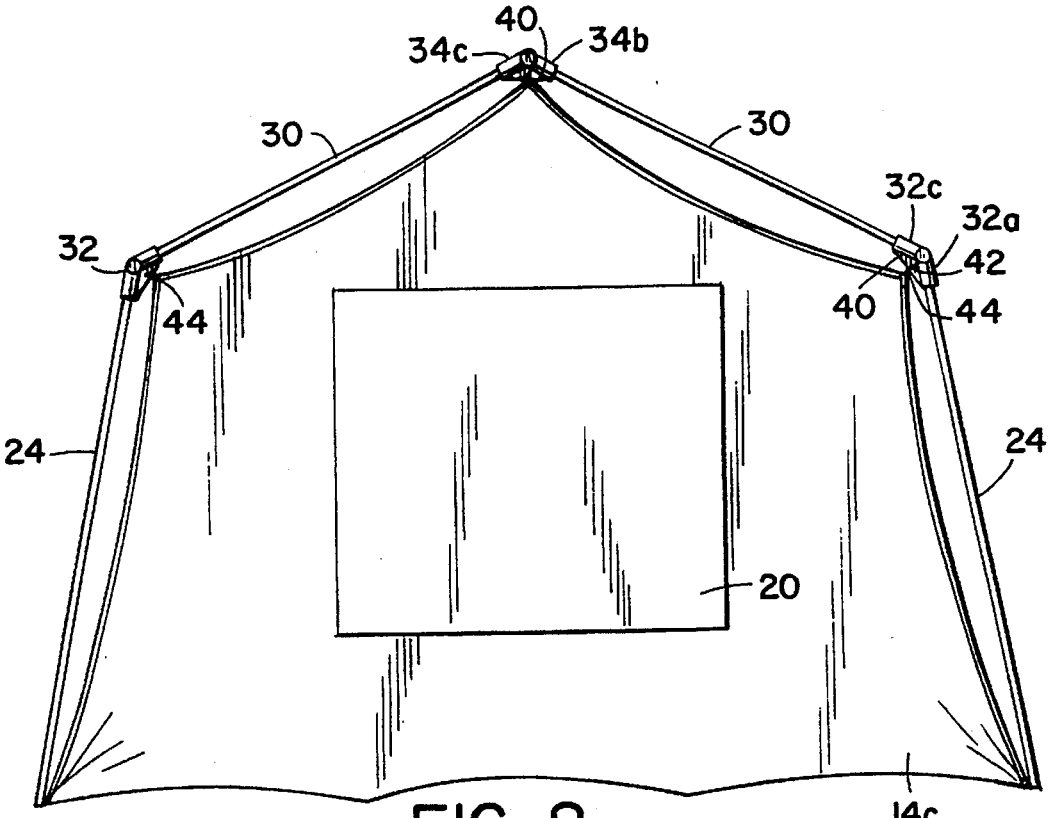
FIG. 8 is a rear view thereof with the window flap closed.

The tent 10 according to the present invention comprises a fabric enclosure 11 (FIG. 1) having a floor 12 (FIG. 6), four walls 14*a*, 14*b*, 14*c*, and 14*d*, and a roof 16 having a raised center ridge line 16*a* and two downwardly sloping sides 16*b* and 16*c*. The four walls consist of a front wall 14*a*, two side walls 14*b* and 14*d*, and a rear wall 14*c*. The front wall 14*a* has a front door 18 in the form of a transparent sheet attached to the front wall 14*a* of the fabric enclosure, which is openable and closeable by a zipper 18*a*, and door flaps 18*b* which may be rolled into an open position and held in place by holders 18c located on either side of the door 18. The rear wall 14*c* has a rear window 20 in the form of a transparent sheet attached to the rear wall 14*c*, and a rear window flap 20*a* which may be rolled upward and held in place by holders 20*b* located above the window 20.

The fabric enclosure 11 is supported in its expanded condition as shown in the drawings by an external frame 22. The frame 22 comprises four upwardly extending tubular leg poles 24 which are slightly splayed outward, a center tubular ridge pole 26, two tubular eave poles 28 extending parallel to the center ridge pole 26, and four tubular ridge-to-eave poles 30, two in the front of the tent and two in the rear.

Figure 2:
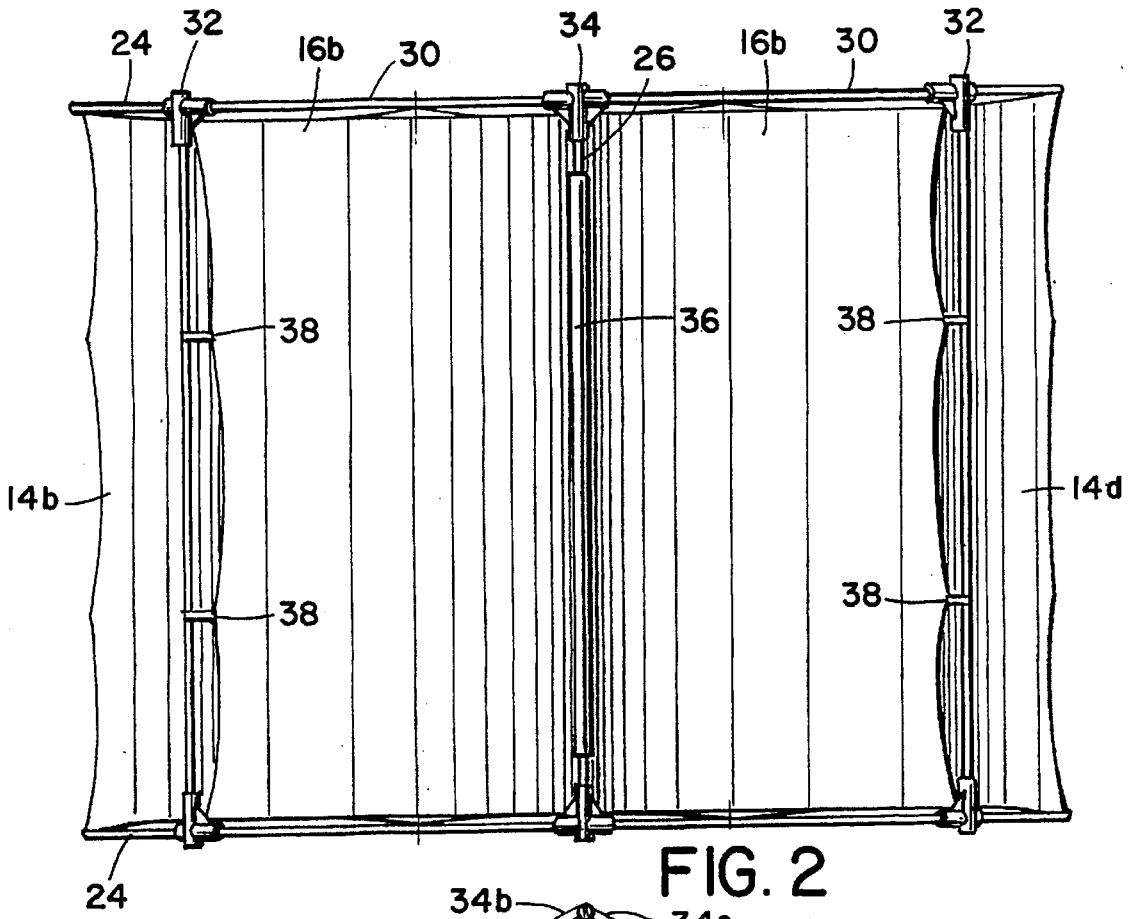
FIG. 2 is a top view thereof.
Figure 3:
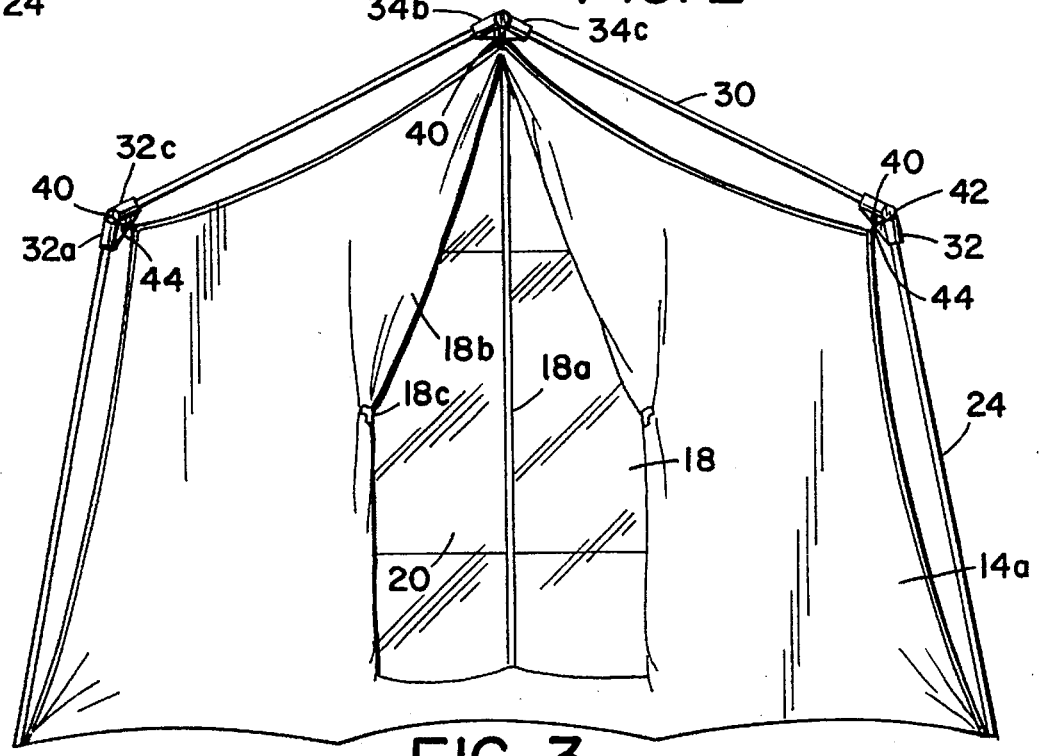
FIG. 3 is a front view thereof.
Figure 4:
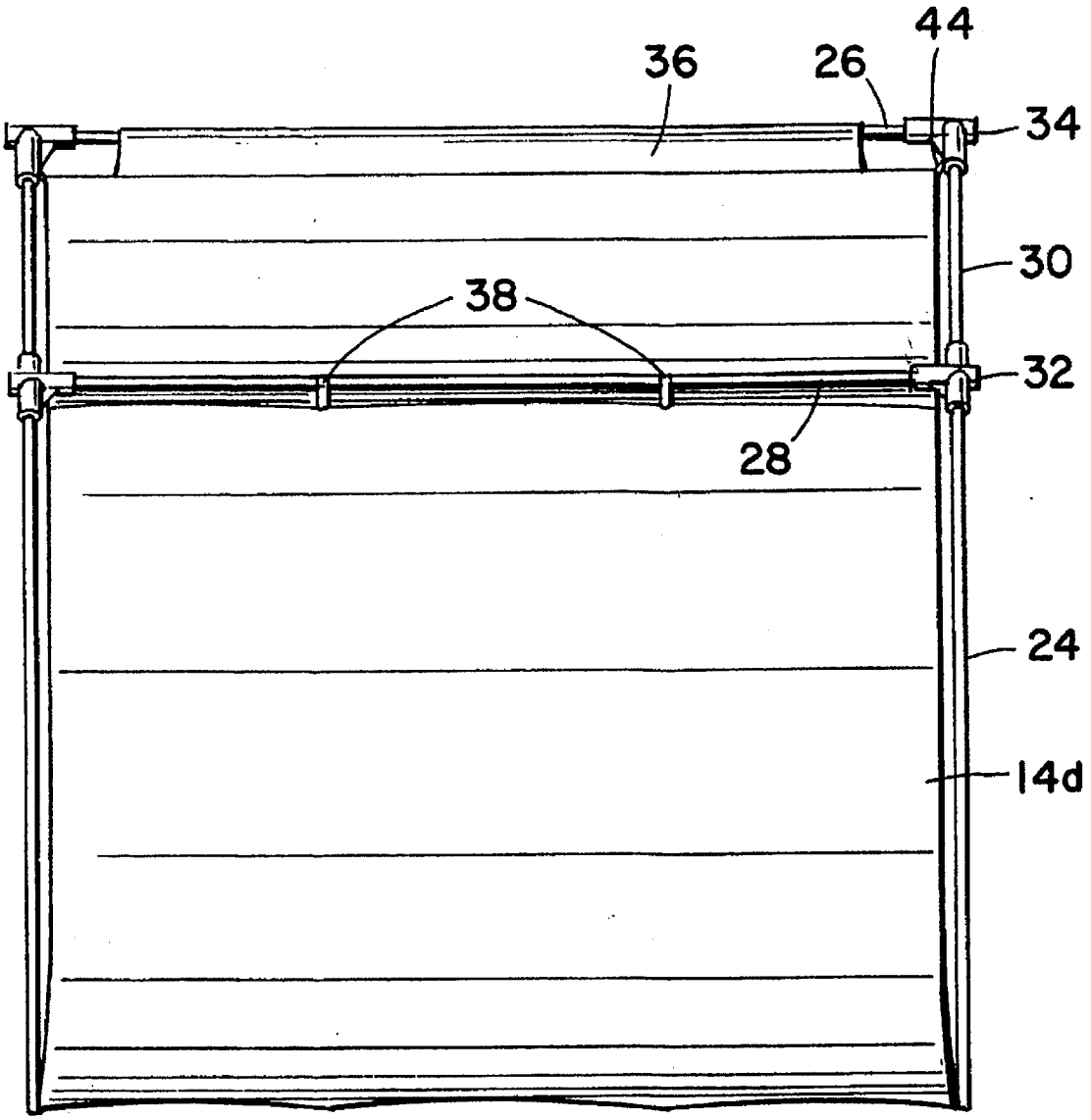
FIG. 4 is a right side view thereof, the left side being identical thereto.

The leg poles 24 are each releasably connected at their upper ends to one eave pole 28 and one ridge-to-eave pole 30 by a pole connector (corner yoke connector) 32 having three tubular members 32*a*, 32*b*, and 32*c* extending in different directions. The ridge-to-eave poles 30 extend at an upward angle from the upper ends of the leg poles 24 so that the center ridge line 16*a* of the roof 16 is raised. The center ridge pole 26 is releasably connected at both ends to the ridge-to-eave poles 30 by pole connectors (center yoke connectors) 34 each having three tubular members 34*a*, 34*b*, and 34*c* extending in different directions. As shown most clearly in FIGS. 2 and 6, the inside diameter of the ends of the tubular members of the corner and center yoke connectors are slightly larger than the outside diameters of the poles which they accept, thus making the poles releasably insertable into the tubular members.

The fabric enclosure 11 is supported in its expanded condition by the external frame 22 as follows. A center ridge sleeve 36 is affixed to the fabric enclosure 11 along the center ridge line 16*a* of the roof 16 and extends substantially the length of the center ridge line 16*a* from the front to the rear of the tent. The inside diameter of the center ridge sleeve 36 is larger than the outside diameter of the center ridge pole 26 so that the center ridge pole 26 is releasably insertable into the sleeve 36.

Four loops 38 (FIG. 2), two on each side of the tent 10, are affixed to the fabric enclosure 11 at the seam between the roof 16 and each of the two side walls 14*b* and 14*d*. The loops 38 are substantially evenly spread apart such that each one of the four loops 38 is situated about one-third of the distance from each corner between two adjacent walls. The inside diameters of the loops 38 are larger than the outside diameters of the eave poles 28 so that the eave poles 28 are releasably insertable into the loops 38.

Figure 5:
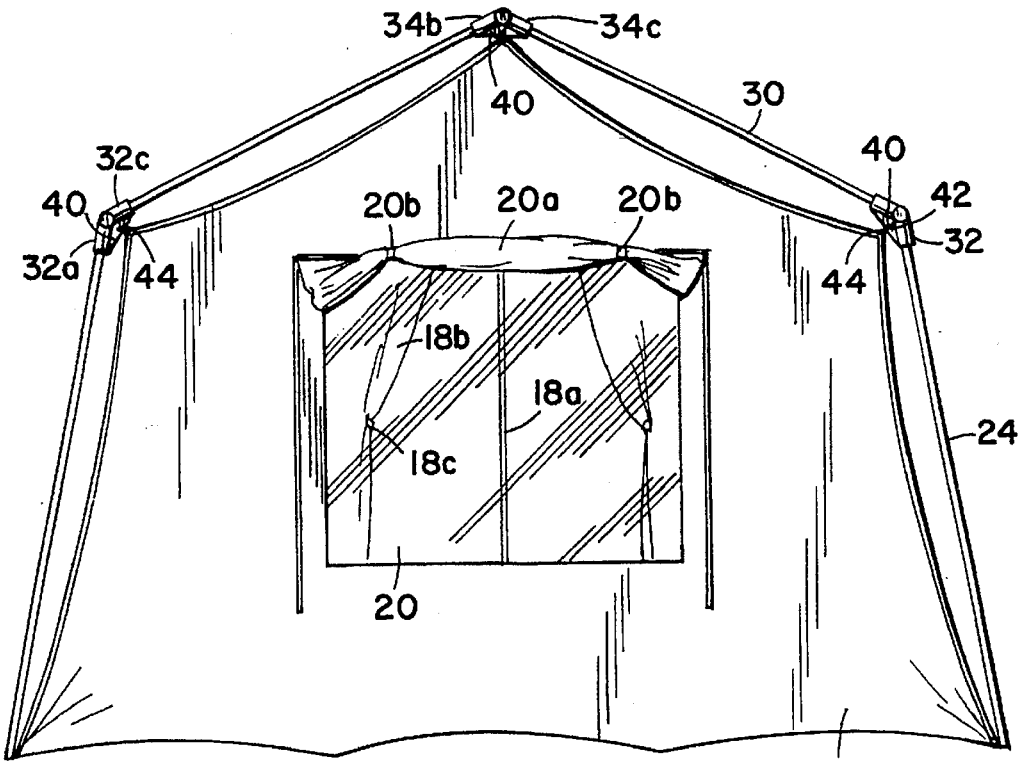
FIG. 5 is a rear view thereof showing the window flap rolled upward.

Each one of the corner yoke connectors 32 includes a flange 40 (FIGS. 1, 3, 5, 7, and 8) extending between the tubular member 32*a* which accepts the leg poles 24 and the tubular member 32*c* which accepts the ridge-to-eave poles 30. Similarly, each one of the center yoke connectors 34 contains a flange 40 (FIGS. 1, 2, 5, and 8) extending between the tubular member 34*b* which accepts one of the ridge-to-eave poles 30 and the tubular member 34*c* which accepts the other ridge-to eave poles 30. The flanges 40 each have an eye 42. The fabric enclosure is supported by the ridge sleeve 36 and the loops 38, as described above, and by connectors 44 attached to the fabric enclosure and releasably engaged to the yoke connectors 32 and 34 via the eyes 42 in the respective flanges 40 of the respective yoke connectors. Six connectors 44 are attached to the fabric enclosure 11, one at each of the four corners between the roof 16 and two adjacent walls, and one at each of the two corners between the center ridge line 16*a* of the roof 16 and the front and rear walls 14*a* and 14*c*. As shown most clearly in FIG. 5, each connector 44 is releasably engageable with an eye 42 of the flange of the yoke connector at the corresponding location, such that the fabric enclosure hangs tautly from the external frame.

Figure 1:
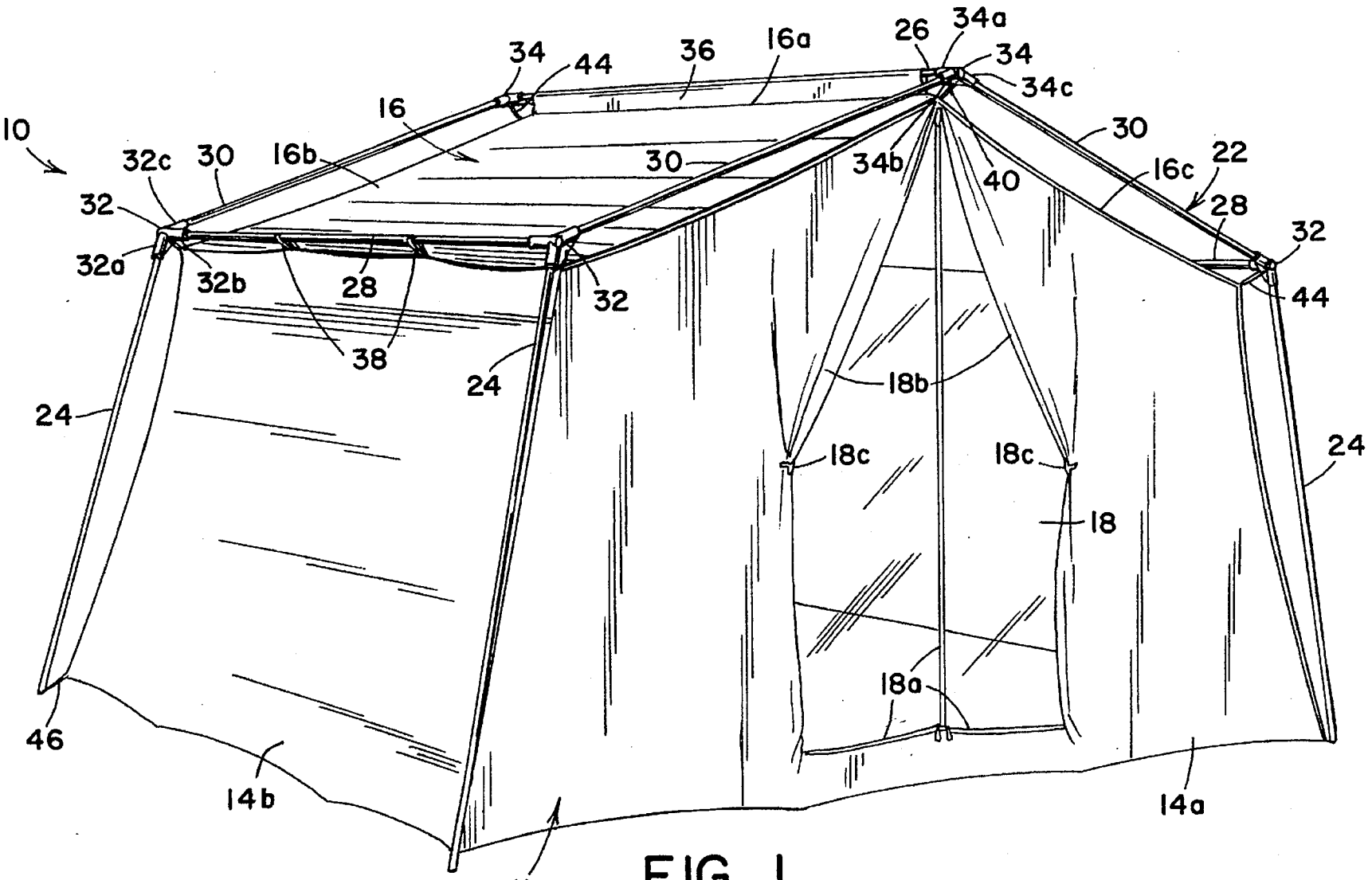
FIG. 1 is a perspective view of the tent taken from a front thereof.

As shown most clearly in FIG. 1, a connector 46 is attached to each of the four bottom corners of the fabric enclosure 11 and releasably attached to the lower ends of each leg pole 24.

I claim:

1. A tent comprising:

a fabric enclosure comprising a plurality of walls and a roof;

an external, free-standing frame which, in an assembled condition thereof, defines a space sufficiently large to encompass the fabric enclosure, the frame comprising:

a plurality of spaced apart, upwardly extending leg poles;

a plurality of roof poles, with at least one roof pole extending between each leg pole and an adjacent leg pole, and a plurality of pole connectors for releasably connecting each leg pole to at least two roof poles, wherein the plurality of roof poles includes at least one ridge pole, at least two eave poles extending in a direction parallel to the at least one ridge pole in an assembled condition of the tent, and a plurality of ridge-to-eave poles each of which is releasably connectable at one end thereof to at least one eave pole by one of the pole connectors and at another end thereof to the at least one ridge pole by at least one center pole connector;

first means for releasably hanging the fabric enclosure at at least one location thereof from at least one of the roof poles, the first means comprising at least one sleeve affixed to the fabric enclosure into which at least one roof pole is releasably insertable; and second means for releasably hanging the fabric enclosure at at least one location thereof from at least one of the pole connectors.

2. The tent of claim 1 wherein the external frame comprises at least four leg poles.

3. The tent of claim 1 wherein each leg pole has a tubular upper end and each roof pole has opposed tubular ends, and wherein each pole connector is a yoke connector comprising at least three tubular members into which the tubular ends of respective poles are releasably insertable.

4. The tent of claim 3 wherein the yoke connector further comprises at least one flange extending between at least two tubular members and wherein the second means comprises a eye in the at least one flange and a connector affixed at one end to the fabric enclosure which at the opposing end thereof is releasably engaged with the eye.

5. The tent of claim 1 wherein the poles are substantially straight.

6. The tent of claim 1 wherein the first means comprises a plurality of loops affixed to the fabric enclosure into which at least one roof pole is releasably insertable.

7. The tent of claim 6 wherein the loops are affixed to the fabric enclosure near at least one seam between a wall and the roof.

8. The tent of claim 1 wherein the sleeve is affixed to the fabric enclosure near the center of the roof and extends along a center ridge line of the roof.

9. The tent of claim 1 wherein the second means comprises an eye in the pole connectors and a connector affixed at one end to the fabric enclosure which at the opposing end thereof is releasably engageable with the eye so that the fabric enclosure hangs tautly from the frame.

10. The tent of claim 9 wherein the connector is affixed to the fabric enclosure near at least one corner formed between the roof and at least one wall thereof.

11. The tent of claim 1 wherein each leg pole has a tubular end and each roof pole has opposed tubular ends, and wherein the pole connectors include corner yoke connectors having three tubular members into which tubular ends of one leg pole, one eave pole and one ridge-to-eave pole are releasably insertable.

12. The tent of claim 1 wherein each roof pole has opposed tubular ends, and wherein the at least one center pole connector is a yoke connector having three tubular members into which tubular ends of the at least one ridge pole and two ridge-to-eave poles are releasably insertable.

13. The tent of claim 1 further comprising third means for releasably and tautly hanging the fabric enclosure at at least one location thereof from the at least one center pole connector.

14. The tent of claim 13 wherein the at least one center pole connector is a yoke connector having three tubular members and at least one flange extending between at least two tubular members, and wherein the third means comprises an eye in the flange of the at least one center pole connector and a connector affixed to the fabric enclosure at one end which at the opposing end is releasably engageable with the eye.

15. The tent of claim 1 further comprising connectors for releasably attaching the fabric enclosure near bottom thereof to lower ends of the leg poles.

16. A tent comprising:

a fabric enclosure comprising a plurality of walls and a roof;

an external, free-standing frame which, in an assembled condition thereof, defines a space sufficiently large to encompass the fabric enclosure, the frame comprising:

a plurality of leg poles which in the assembled condition of the tent are spaced apart and extend upwardly, with a lower end of each leg pole supported by a supporting surface to thereby support the frame;

a plurality of roof poles which are substantially straight in the assembled condition of the tent, the roof poles arranged in the assembled condition of the tent so that at least two roof poles extend at an upward angle from upper ends of at least two leg poles; and a plurality of pole connectors for releasably connecting the upper end of each leg pole to an end of at least one roof pole;

wherein the plurality of roof poles includes at least one center ridge pole and a plurality of ridge-to-eave poles each of which is releasably connectable at one end thereof to the upper end of one leg pole by one of the pole connectors and at another end thereof to the at least one center ridge pole by at least one center pole connector, wherein each roof pole has opposed tubular ends, and wherein the at least one center pole connector is a yoke connector having three tubular members into which tubular ends of the at least one center ridge pole and two ridge-to-eave poles are releasably insertable;

the tent further comprising means for hanging the fabric enclosure from the frame, the means for hanging comprising at least one sleeve affixed to the fabric enclosure into which at least one roof pole is releasably insertable.

17. The tent of claim 16 wherein the plurality of roof poles further includes at least two eave poles each extending between two adjacent leg poles in a direction parallel to the at least one center ridge pole in an assembled condition of the tent.

18. The tent of claim 17 wherein each leg pole has a tubular upper end and each roof pole has opposed tubular ends, and wherein the pole connectors include corner yoke connectors each having three tubular members into which tubular ends of one leg pole, one eave pole and one ridge-to-eave pole are releasably insertable.

19. A tent comprising:

a fabric enclosure comprising a plurality of walls and a roof;

an external, free-standing frame which, in an assembled condition thereof, defines a space sufficiently large to encompass the fabric enclosure, the frame comprising:

a plurality of leg poles which in the assembled condition of the tent are spaced apart and extend upwardly, with a lower end of each leg pole supported by a supporting surface to thereby support the frame;

a plurality of roof poles which are substantially straight in the assembled condition of the tent, the roof poles arranged in the assembled condition of the tent so that at least two roof poles extend at an upward angle from upper ends of at least two leg poles; and a plurality of pole connectors for releasably connecting the upper end of each leg pole to an end of at least one roof pole;

wherein the plurality of roof poles includes at least one center ridge pole and a plurality of ridge-to-eave poles each of which is releasably connectable at one end thereof to the upper end of one leg pole by one of the pole connectors and at another end thereof to the at least one center ridge pole by at least one center pole connector, wherein each roof pole has opposed tubular ends, and wherein the at least one center pole connector is a yoke connector having three tubular members into which tubular ends of the at least one center ridge pole and two ridge-to-eave poles are releasably insertable;

first means for releasably hanging the fabric enclosure at at least one location thereof from at least one of the roof poles, the first means comprising at least a sleeve affixed to the fabric enclosure into which at least one roof pole is releasably insertable; and second means for releasably hanging the fabric enclosure at at least one location thereof from at least one of the pole connectors.

20. The tent of claim 19 wherein the plurality of roof poles further includes at least two eave poles each extending between two adjacent leg poles in a direction parallel to the at least one center ridge pole in an assembled condition of the tent.

21. The tent of claim 20 wherein each leg pole has a tubular upper end and each roof pole has opposed tubular ends, and wherein the pole connectors include corner yoke connectors each having three tubular members into which tubular ends of one leg pole, one eave pole and one ridge-to-eave pole are releasably insertable.

22. The tent of claim 19 wherein the second means comprises an eye in the pole connectors and a plurality of connectors each of which is affixed at one end to the fabric enclosure and at the opposing end to the eye so that the fabric enclosure hangs tautly from the frame.

23. The tent of claim 22 wherein the connectors are each affixed to the fabric enclosure near each of the corners formed between the roof and at least one wall thereof.

24. A tent comprising:

a fabric enclosure comprising a plurality of walls and a roof, the roof having, in an assembled condition of the tent, a center ridge line and at least two downwardly sloping sides, the fabric enclosure defining a plurality of corners at which two or more walls or roof sides meet;

an external, free-standing frame which, in an assembled condition thereof, defines a space sufficiently large to encompass the fabric enclosure, the frame comprising a plurality of leg poles which in the assembled condition of the tent are spaced apart and extend upwardly, with a lower end of each leg poles supported by a supporting surface to thereby support the frame, and a plurality of roof poles which are connected to the leg poles at a plurality of corners corresponding to the corners of the fabric enclosure, the plurality of poles including a plurality of ridge-to eave poles each of which is releasably connectable at one end thereof to an upper end of one leg pole by a pole connector such that it extends in the assembled condition of the frame at an upward angle from the upper end of the leg pole; and a center ridge pole which is releasably connectable at each opposing end thereof to at least two ridge-to-eave poles by a center pole connector, wherein the center ridge pole and ridge-to-eave poles have opposed tubular ends, and wherein the center pole connector has three tubular members into which tubular ends of the center ridge pole and two of the ridge-to-eave poles are releasably insertable, the tent further comprising:

at least one sleeve affixed to the fabric enclosure near the center ridge line into which the center ridge pole is releasably insertable; and corner hanging means for releasably hanging the fabric enclosure at the corners thereof from the corresponding corners of the frame.

25. The tent of claim 24 wherein the corner hanging means comprises a plurality of connectors each of which is releasably engageable at one end to the fabric enclosure at a corner thereof and at an opposing end with one of the pole connectors so that the fabric enclosure hangs tautly from the frame.

26. A tent comprising:

a fabric enclosure comprising a floor, a plurality of walls and a roof;

an external, free-standing frame which, in an assembled condition thereof, defines a space sufficiently large to encompass the fabric enclosure, the frame comprising:

at least four spaced apart, upwardly extending leg poles each having two ends, at least the upper end of which is tubular, and the lower end of which is supported by a supporting surface to thereby support the frame;

a plurality of straight roof poles each having two tubular ends, including at least one center ridge pole, at least two eave poles arranged in parallel to the at least one center ridge pole, and at least four ridge-to-eave poles;

the roof poles arranged in the assembled condition of the tent so that each eave pole extends laterally between two adjacent leg poles and each ridge-to-eave pole extends between each leg pole and the center ridge pole, with adjacent eave and ridge-to-eave poles each having an end adjacent each other and adjacent an upper end of a given leg pole, the adjacent eave and ridge-to-eave poles extending away from each other and from the given leg pole toward respective other leg poles;

at least four corner yoke connectors each of which releasably connects each leg pole at the upper end thereof to at least one eave pole at one end thereof and at least one ridge-to-eave pole at a first end thereof; and at least two center yoke connectors each of which releasably connects the at least one center ridge pole at one end thereof to at least two ridge-to-eave poles at second ends thereof;

the corner and center yoke connectors each having at least three tubular members extending in different directions into which tubular ends of respective poles are releasably insertable and at least one flange extending between two of the at least three tubular members, each flange having at least one eye;

a plurality of loops and at least one sleeve for releasably hanging the fabric enclosure at a plurality of locations thereof from a plurality of roof poles; and a plurality of connectors affixed to the fabric enclosure at one end and at opposing ends releasably engageable with the eyes of the corner and center yoke connectors for tautly hanging the fabric enclosure at a plurality of locations thereof from the corner and center yoke connectors.

* * * * *